United States Patent [19]

Zenoni

[11] Patent Number: 5,046,536

[45] Date of Patent: Sep. 10, 1991

[54] DEVICE FOR COUNTING TURNS UNWINDING FROM WEFT FEEDERS

[75] Inventor: Pietro Zenoni, Leffe, Italy

[73] Assignee: L.G.L. Electronics S.p.A., Bergamo, Italy

[21] Appl. No.: 527,393

[22] Filed: May 23, 1990

[30] Foreign Application Priority Data

Jun. 6, 1989 [IT] Italy ..... 67444 A/89

[51] Int. Cl.[5] ..... D03D 47/34

[52] U.S. Cl. ..... 139/452

[58] Field of Search ..... 139/452; 242/47.01

[56] References Cited

U.S. PATENT DOCUMENTS 4,936,356 6/1990 Ghiardo ..... 139/452

FOREIGN PATENT DOCUMENTS 28552 2/1985 Japan ..... 139/452

1-006151 1/1989 Japan ..... 139/452

*Primary Examiner*—Andrew M. Falik

*Attorney, Agent, or Firm*—Guido Modiano; Albert Josif

[57] ABSTRACT

A weft feeder for weaving looms including a fixed drum, a rotating arm winding, a plurality of thread turns on said drum, an asynchronous motor for said rotating arm, braking means for breaking thread unwinding from said fixed drum, a guiding ring for guiding unwound thread and a piezoelectric transducer rigidly associated to the side of the solid of revolution generated by the unwinding thread and adapted to emit an electric pulse upon every passage of the thread at the generatrix of the solid of revolution which is arranged in the meridian plane which contains or intersects the axis of a feeler associated with the transducer.

8 Claims, 2 Drawing Sheets

DEVICE FOR COUNTING TURNS UNWINDING FROM WEFT FEEDERS

BACKGROUND OF THE INVENTION

The present invention relates to a device for counting the turns unwinding from weft feeders of weaving looms, allowing an automatic adjustment of the speed of said feeders.

Typically weft feeders are devices provided with a fixed drum on which a rotating arm, moved by an asynchronous motor, winds a plurality of thread turns which are progressively unwound by the loom or by another textile machine; the tension of the thread at the output of the feeder is controlled by a braking means which can be constituted by a ring of bristles or by a set of metallic laminae.

The reserve of turns wound on the fixed drum varies between a maximum and a minimum value indicated by corresponding mechanical and/or optical feelers.

In order to avoid disadvantages deriving from continuous stops and starts of the motor, which can produce tangling and/or undesirable variations in the tension of the thread, it is important that the reserve of turns be always comprised between said maximum and minimum values, and this implies that the feed speed of the turns of the reserve must coincide, or substantially coincide, with the removal rate. The latter, however, is generally unknown and in any case is significantly variable during the operation of the textile machine, especially in the case of shuttle-less looms, such as jet looms and the like.

SUMMARY OF THE INVENTION

The aim of the present invention is to provide a device for counting the turns which unwind from the drum of the prefeeder and provide a consequent indication of the unwinding rate of the thread which, numerically processed by a microprocessor, allows to vary the rotation rate of the turn-depositing arm so as to adapt the deposition rate of the turns to the removal rate.

An object of the present invention is to provide a counting device which is extremely simple, reliable and capable of transducing the speed datum in terms of electric pulses which can be applied directly to the processing microprocessor.

A further object of the present invention is to provide a device that is not hindering the correct unwinding of the thread from the feeder drum.

This aim, these important objects and others which will become apparent from the following detailed description are achieved by a device for counting turns unwinding from weft feeders, as defined in the appended claims.

BRIEF DESCRIPTION OF THE DRAWINGS

The characteristics and advantages of the present invention will become apparent from the following detailed description and with reference to the accompanying drawings, given by way of non-limitative example, wherein.

DESCRIPTION OF THE PREFERRED EMBODIMENTS

Figure 1:
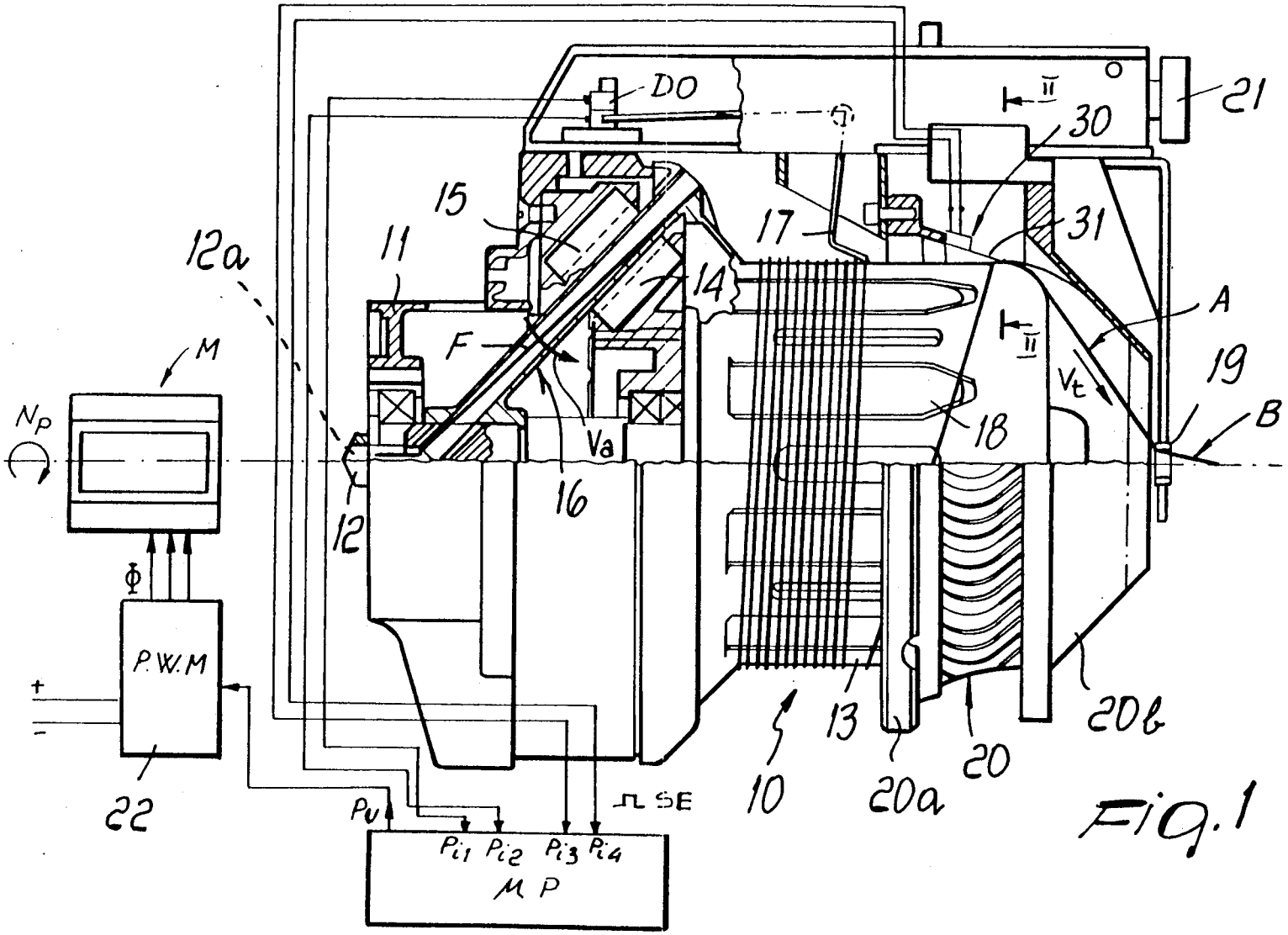
FIG. 1 is a schematic partial sectional view of a weft feeder with the counting device according to the present invention.
Figure 2:
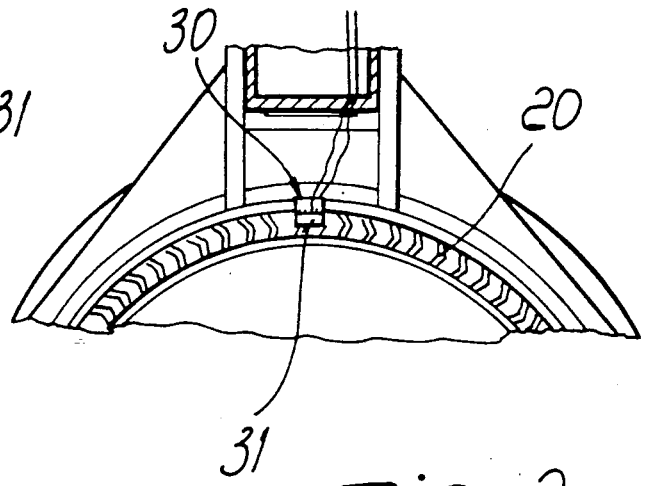
FIG. 2 is a partial enlarged-scale front view taken along the line III—III of FIG. 1.

Initially with reference to FIGS. 1 and 2, 10 generally indicates the known weft feeder which comprises a fixed base 11, a motor shaft 12 and a fixed drum 13 which is freely rotatably mounted on said shaft 12 and is prevented from rotating by the action of permanent magnets 14 which co-operate with corresponding magnets 15 rigidly associated with the base 11. In a per se known manner, the shaft 12 has an axial cavity **12*a* and a cantilevered arm 16 which is also hollow; the thread F passes in the cavity of the shaft and of the arm and unwinds from a spool (not illustrated) to be wound by said arm onto the drum 13 in spaced turns which constitute a reserve of thread which is variable between a maximum value and a minimum value indicated by a mechanical feeler 17** associated for example with an optical device DO capable of emitting, in a known manner, electric signals of reserve minimum and maximum.

Spacing of the turns is ensured by an also known advancement system which uses a plurality of rods 18 which cyclically rise from slots of the drum 13.

The shaft 12 is rotated, with an angular speed Np, by an asynchronous electric motor M which is powered by a variable-frequency system 22 of the known PWM type described in chapter 16 of the "Hexfet Designer's Manual" of Int. Rectifier, California, USA.

The system 22 is driven by a microprocessor $\mu$P which sends frequency increase or decrease signals in the manner described hereinafter by means of a port "Pu". The outputs of the optical device DO associated with the feeler 17 are fed to respective input ports "Pi" of the microprocessor $\mu$P.

The thread is fed from the drum to the loom or to another textile machine and unwinds with a linear speed Vt which is generally unknown, passing through a thread guiding ring 19.

The tension of the thread during unwinding of the turns is controlled by a braking means which is typically constituted by a ring of bristles or metallic laminae 20 which elastically engage the thread and are carried by an annular support **20*a* co-operating, in the case of laminae, with a conical ring 20*b* which is axial movable by means of a knob 21** for adjusting the braking action.

In the unwinding motion, the thread F defines a solid of revolution which is substantially constituted by a first frustum-shaped portion A which extends between the drum 13 and the thread-guiding ring 19 and by a second conical portion B which extends beyond the thread-guiding ring.

According to the present invention, the linear unwinding speed Vt of the thread is measured, sensing the passage of said thread in a generic meridian plane of said solid of revolution by employing at least one transducer 30 which is arranged at said meridian plane, is located substantially tangent to said solid and is responsive to the tangential component of the motion of the thread.

The transducer is constituted by a piezoelectric crystal, for example of the type PXE.5 manufactured by the Philips company. A feeler 31, in the shape of an oscillable bar or plate, is mechanically connected with said crystal (in particular is in contact therewith) and is adapted to be moved by the thread which cyclically passes on said plate or bar upon every unwinding of turns. The crystal and the associated feeler form a sort of piezoelectric pickup which can provide a pulsed electric signal SE upon the passage of every turn.

In the embodiment of FIGS. 1 and 2, the transducer 30 is rigidly connected to the annular support 20*a* and has its feeler 31 in contact with one of the laminae of the braking means 20 or with a set of bristles thereof, so that when the thread passes below said lamina or set of bristles it transmits a corresponding vibration to the feeler 31 causing the transducer 30 to generate an electric signal SE which, after being amplified and squared, is sent to an input port "Pi" of the microprocessor $\mu$P.

Said microprocessor is programmed to count the pulses emitted in the time unit, to calculate the consequent speed Vt of the unwinding thread (with $Vt=2\pi nr$, where r is the radius of the solid of revolution in the point being considered and n is the number of turns, which is equal to the number of counted pulses in the time unit) and to compare the speed Vt thus calculated to the winding speed Va, which is equal to the peripheral speed $V=2\pi NpR$ of the arm 16 (R being the radius of the circle traced by the end of said arm), which is in turn proportional to the power supply frequency of the motor M.

From the comparison between the two speeds Vt and Va, the microprocessor obtains a differential datum and, according to the sign of the latter, increases or decreases the power supply frequency of the motor M depending respectively on whether $$Va < Vt$$

$$Va > Vt$$

Figure 3:
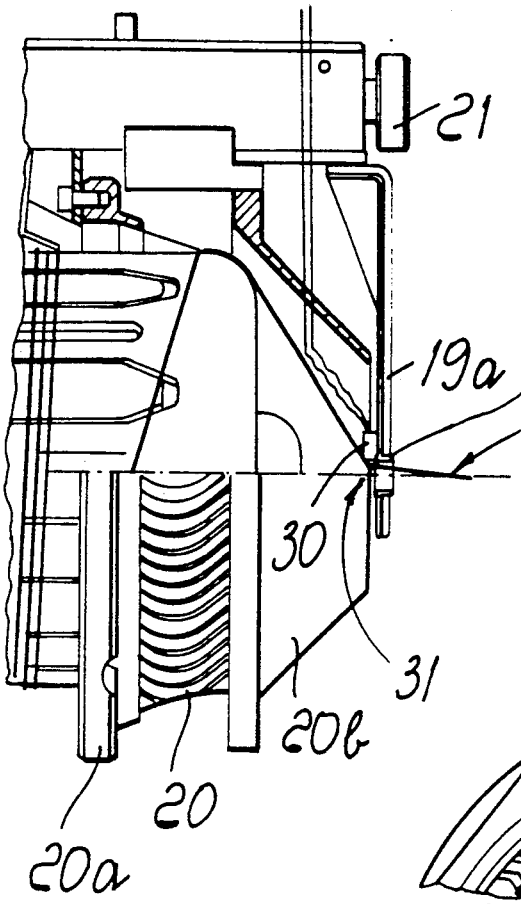
FIG. 3 is a partial sectional view, similar to FIG. 1, illustrating a different embodiment of the invention.
Figure 4:
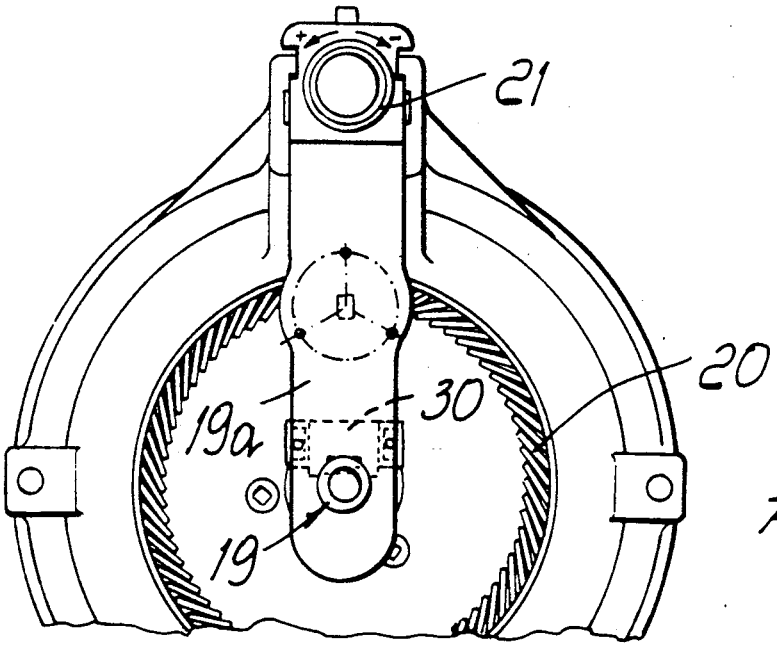
FIG. 4 is a partial enlarged-scale front view of the embodiment of FIG. 3.

In the embodiment of FIGS. 3 and 4, the transducer 30 is rigidly associated with the support 19*a* of the thread-guiding ring 19, preferably on the internal side of said support, as illustrated in the FIGURE, and is provided with a feeler constituted by an oscillable bar 31 which intersects the conical portion B of the solid of revolution defined by the unwinding turns.

In this case, too, the thread, by rotating along the periphery of the ring 19, cyclically makes contact with the bar 31, which transmits to the transducer 30 the vibration imparted thereto by the thread, with the consequent emission of pulsed signals SE.

I claim:

1. In a weft feeder for weaving looms including a fixed drum, a rotating arm winding, a plurality of thread turns on said drum, an asynchronous motor for said rotating arm, braking means for breaking thread unwinding from said fixed drum and a guiding ring for guiding unwound thread, said unwinding thread describing a solid of revolution, a device for counting turns of thread unwinding from the fixed drum, comprising detecting means for detecting passage of the unwinding thread, said detecting means being arranged laterally to the solid of revolution described by the unwinding thread, being responsive to a tangential component of the thread movement to detect passage of the thread and generating an electric pulse upon each passage of the thread, wherein said detecting means comprises a feeler and a transducer in contact with said feeler, said transducer generating said electric pulse upon each passage of the thread at a generatrix of said solid of revolution arranged in a meridian plane passing through said feeler.

2. A weft feeder according to claim 1, wherein said transducer includes a piezoelectric pickup and said feeler includes an elongated element, said pickup generating said electric pulse every time an unwinding turn causes vibration of said feeler.

3. In a weft feeder for weaving looms including a fixed drum, a rotating arm winding, a plurality of thread turns on said drum, an asynchronous motor for said rotating arm, braking means for breaking thread unwinding from said fixed drum and a guiding ring for guiding unwound thread, said unwinding thread describing a solid of revolution, a device for counting turns of thread unwinding from the fixed drum, comprising detecting means for detecting passage of the unwinding thread, said detecting means being arranged laterally to the solid of revolution described by the unwinding thread, being responsive to a tangential component of the thread movement to detect passage of the thread and generating an electric pulse upon each passage of the thread, wherein said detecting means comprises a transducer rigid with a support of the braking means of the thread which unwinds from the fixed drum of the weft feeder and a feeler arranged in contact with the braking means which transmit thereto a vibration caused by the passage of the thread.

4. In a weft feeder for weaving looms including a fixed drum, a rotating arm winding, a plurality of thread turns on said drum, an asynchronous motor for said rotating arm, braking means for breaking thread unwinding from said fixed drum and a guiding ring for guiding unwound thread, said unwinding thread describing a solid of revolution, a device for counting turns of thread unwinding from the fixed drum, comprising detecting means for detecting passage of the unwinding thread, said detecting means being arranged laterally to the solid of revolution described by the unwinding thread, being responsive to a tangential component of the thread movement to detect passage of the thread and generating an electric pulse upon each passage of the thread, wherein said detecting means comprises a transducer rigid with said guiding ring and a feeler including a bar intersecting said solid of revolution which extends beyond said guiding ring; said bar being cyclically struck by the unwinding thread which rotates along a periphery of the guiding ring during unwinding of the turns.

5. In a weft feeder for weaving looms including a fixed drum, a rotating arm winding, a plurality of thread turns on said drum, an asynchronous motor for said rotating arm, braking means for breaking thread unwinding from said fixed drum and a guiding ring for guiding unwound thread, said unwinding thread describing a solid of revolution, a device for counting turns of thread unwinding from the fixed drum, comprising detecting means for detecting passage of the unwinding thread, said detecting means being arranged laterally to the solid of revolution described by the unwinding thread, being responsive to a tangential component of the thread movement to detect passage of the thread and generating an electric pulse upon each passage of the thread, said weft feeder including a microprocessor, wherein the electric pulse generated by said detecting means upon each passage of unwinding thread is applied, after amplification and squaring, to an input port of said microprocessor further controlling power supply frequency of said asynchronous motor.

6. A weft feeder according to claim 5, wherein said microprocessor includes means for counting said electric pulses and calculating a corresponding thread unwinding speed, for comparing said thread unwinding speed with a thread winding speed, and for selectively increasing and decreasing said thread winding speed through corresponding variations of the power supply frequency of said asynchronous motor, depending on difference between said thread unwinding and winding speeds.

7. In a weft feeder for weaving looms including a fixed drum, a rotating arm winding, a plurality of thread turns on said drum, an asynchronous motor for said rotating arm, braking means for breaking thread unwinding from said fixed drum and a guiding ring for guiding unwound thread, said unwinding thread describing a solid of revolution, a device for counting turns of thread unwinding from the fixed drum, comprising detecting means for detecting passage of the unwinding thread, said detecting means being arranged laterally to the solid of revolution described by the unwinding thread, being responsive to a tangential component of the thread movement to detect passage of the thread and generating an electric pulse upon each passage of the thread, said weft feeder including a microprocessor, wherein said detecting means is located outside of said solid of revolution generated by the unwinding thread.

8. In a weft feeder for weaving looms including a fixed drum, a rotating arm winding a plurality of thread turns on said drum defining a reserve of turns, an asynchronous motor for moving said rotating arm at a controllable thread winding speed, braking means for breaking thread unwinding from said fixed drum and a guiding ring for guiding unwound thread, said unwinding thread having a circumferential speed component with respect to said fixed drum, a device for automatically adjusting the reserve of turns of said drum, comprising means for detecting said circumferential speed component of said unwinding thread, means for comparing said circumferential speed component with said thread winding speed and generating a differential speed having a sign and means for controlling said motor depending on said sign of said differential speed to selectively increase and decrease said thread winding speed.

* * * * *